US011262085B2

(12) United States Patent
Hagström

(10) Patent No.: US 11,262,085 B2
(45) Date of Patent: Mar. 1, 2022

(54) APPARATUS FOR CONDITIONING A SPACE

(71) Applicant: Halton Oy, Kausala (FI)

(72) Inventor: Kim Hagström, Lahti (FI)

(73) Assignee: HALTON OY, Kausala (FI)

( * ) Notice: Subject to any disclaimer, the term of this patent is extended or adjusted under 35 U.S.C. 154(b) by 0 days.

(21) Appl. No.: 15/435,967

(22) Filed: Feb. 17, 2017

(65) Prior Publication Data

US 2017/0248326 A1 Aug. 31, 2017

(30) Foreign Application Priority Data

Feb. 25, 2016 (EP) ..... 16157363

(51) Int. Cl.

| | |
|---|---|
| ***F24F 1/00*** | (2019.01) |
| ***F24F 1/0014*** | (2019.01) |
| ***F24F 1/0047*** | (2019.01) |
| ***F24F 1/0071*** | (2019.01) |
| ***F24F 1/0323*** | (2019.01) |
| ***F24F 13/20*** | (2006.01) |

(52) U.S. Cl.

CPC ..... *F24F 1/0014* (2013.01); *F24F 1/0047* (2019.02); *F24F 1/0071* (2019.02); *F24F 1/0323* (2019.02); *F24F 13/20* (2013.01)

(58) Field of Classification Search

CPC .. F24F 1/01; F24F 2001/0037; F24F 2221/14; F24F 13/28; F24F 13/30; F24F 1/0014; F24F 1/0059; F24F 13/20

USPC ..... 165/53–55, 77, 119

See application file for complete search history.

(56) References Cited

U.S. PATENT DOCUMENTS 1,907,450 A * 5/1933 Shipp ..... F24D 19/06 165/54
1,927,991 A * 9/1933 Pendleton ..... F24D 19/0002 165/129
2,122,454 A * 7/1938 Child ..... F28D 1/024 165/122
2,299,939 A * 10/1942 Swanson ..... F24F 1/0007 165/122

(Continued)

FOREIGN PATENT DOCUMENTS

CN 2342299 Y 10/1999
DE 4233932 A1 * 4/1994 ..... F24F 1/0011

(Continued)

OTHER PUBLICATIONS

Extended European Search Report issued by the European Patent Office in relation to European Patent Application No. 16157363.9-1602 dated Aug. 19, 2016 (6 pages).

(Continued)

*Primary Examiner* — Harry E Arant
(74) *Attorney, Agent, or Firm* — Robert P. Michal, Esq.; Carter, DeLuca & Farrell LLP

(57) ABSTRACT

An apparatus for conditioning a space includes a frame; an internal space within the frame, into which internal space a supply air flow is conducted; a cover panel into which a perforated area is arranged, the perforated area including perforations, each perforation having a diameter; and a heat exchanger arranged within the frame and including at least one heat exchanger coil, lamellas, and openings arranged between each adjacent lamella, each opening having a length.

15 Claims, 3 Drawing Sheets

(56) References Cited

U.S. PATENT DOCUMENTS

| | | | | |
|---|---|---|---|---|
| 5,014,774 | A * | 5/1991 | Siak et al. | F25B 39/022 165/133 |
| 5,042,575 | A | 8/1991 | Lindsay | |
| 5,248,454 | A | 9/1993 | Thomas | |
| 5,676,197 | A * | 10/1997 | Diebold | F01P 11/12 165/119 |
| 7,000,688 | B2 * | 2/2006 | Horttanainen | F24F 11/81 165/123 |
| 8,006,512 | B2 * | 8/2011 | Sanagi | F24F 1/0011 62/426 |
| 9,255,717 | B2 * | 2/2016 | Nam | F24F 1/0007 |
| 2002/0062948 | A1 * | 5/2002 | Horttanainen | F24F 11/81 165/123 |
| 2006/0118281 | A1 * | 6/2006 | Radke | B60K 11/08 165/119 |
| 2007/0060038 | A1 * | 3/2007 | Yamashita | F24F 1/0007 454/248 |
| 2008/0085672 | A1 | 4/2008 | Creed et al. | |
| 2010/0025013 | A1 * | 2/2010 | Zha | H01L 23/427 165/80.3 |
| 2010/0242726 | A1 | 9/2010 | Enbom et al. | |
| 2013/0291735 | A1 * | 11/2013 | Livchak | A61L 9/20 96/224 |
| 2014/0216693 | A1 * | 8/2014 | Pekarsky | B60H 1/00278 165/104.31 |
| 2015/0099455 | A1 | 4/2015 | Surminski et al. | |
| 2016/0097374 | A1 * | 4/2016 | Rollick | F03D 9/37 60/641.12 |
| 2019/0024963 | A1 * | 1/2019 | Kobayashi | F28D 1/0477 |

FOREIGN PATENT DOCUMENTS

| | | | |
|---|---|---|---|
| GB | 2415247 | A | 12/2005 |
| JP | H0276000 | A | 3/1990 |
| JP | H08296867 | A | 11/1996 |
| JP | 2004116845 | A | 4/2004 |
| JP | 2004239486 | A | 8/2004 |
| JP | 2008101818 | A | 5/2008 |
| JP | 2009145025 | A | 7/2009 |
| JP | 2010210106 | A | 9/2010 |
| JP | 2014215027 | A | 11/2014 |
| JP | 2015042932 | A | 3/2015 |
| JP | 2015137842 | A | 7/2015 |
| KR | 20040095581 | A * | 11/2004 |
| WO | 03001006 | A1 | 1/2003 |
| WO | WO-2004/021957 | A1 | 3/2004 |
| WO | WO-2011/040853 | A1 | 4/2011 |

OTHER PUBLICATIONS

Communication pursuant to Article 94(3) EPC issued by the European Patent Office in relation to European Application No. 16 157 363.9 dated Mar. 26, 2019 (4 pages).

Office Action issued by the China National Intellectual Property Administration in relation to Chinese Application No. 201710101986.5 dated Apr. 30, 2019 (10 pages) along with English language translation (8 pages).

Chinese language Search Report issued by the China National Intellectual Property Administration in relation to Chinese Application No. 201710101986.5 dated Apr. 22, 2019 (3 pages).

English Translation of Office Action issued by the Chinese National Intellectual Property Administration in relation to Chinese Application No. 2017101019865, dated Feb. 7, 2021, 9 pages.

English Translation of Japanese Notice of Reasons for Refusal dated Feb. 26, 2021, issued in relation to Japanese Appln. No. 2017029002, 5 pages.

Notice of Reasons for Refusal issued by the Japanese Patent Office in relation to Japanese Application. No. 2017-029002 dated Nov. 9, 2021 (3 pages), along with English language translation (5 pages).

* cited by examiner

APPARATUS FOR CONDITIONING A SPACE

CROSS-REFERENCE TO RELATED APPLICATIONS

This Application claims priority to European Application No. 16157363.9, filed Feb. 25, 2016 the entire disclosure of which is incorporated herein by reference.

BACKGROUND

HVAC, heating, ventilating, and air conditioning, is a technology for indoor environmental comfort. Its goal is to provide thermal comfort and acceptable indoor air quality. HVAC system design is a sub-discipline of mechanical engineering, based on the principles of thermodynamics, fluid mechanics, and heat transfer. Refrigeration is sometimes added to the abbreviation as HVAC&R or HVACR, or ventilating is dropped out as in HACR (such as in the designation of HACR-rated circuit breakers). HVAC is important in indoor design where safe and healthy building conditions are regulated with respect to temperature and humidity, using fresh air from outdoors.

Ventilating (V) is the process of changing or replacing air in any space to provide high indoor air quality, for example to control temperature, replenish oxygen, or remove moisture, odors, smoke, heat, dust, airborne bacteria, and carbon dioxide. Ventilation is used to remove unpleasant smells and excessive moisture, introduce outside air, to keep interior building air circulating, and to prevent stagnation of the interior air. Ventilation includes both the exchange of air to the outside as well as circulation of air within the building. It is one of the most important factors for maintaining acceptable indoor air quality in buildings. Methods for ventilating a building may be divided into mechanical or forced and natural types.

Air condition (AC) is the process of altering the properties of air within a space to desired conditions, those properties primarily being temperature and humidity. The aim is typically to distribute conditioned air into a space to improve the thermal comfort (lowering or raising the temperature) and air quality.

The current single room air conditioners for environments are typically arranged into or on the ceiling of an air-conditioned room. In an air conditioner, there is a heat exchanger or radiator in which heat exchanging medium is arranged to circulate in a coil covered by lamellas or fins that distribute the incoming air evenly into the heat exchanger. The heat exchanger may be arranged into a frame, and it is typically covered by detachable cover panel, which can be removed for cleaning the air conditioner. Filters are used in some installations to prevent the heat exchanger from clogging. Secondary filters are used in some installations to ensure the quality of air re-entering the space. Fans or induction of fresh air are used to circulate the air in and out of the air conditioner.

Air conditioners require periodic specialist cleaning and maintenance, such as vacuuming of the heat exchanger to ensure high level of hygiene within the room or space. Additionally, air conditioners comprising a filter through which air is led prior to its conditioning with the heat exchanger require regular changing of filters. The specialist cleaning is an additional cost to the building owner and it typically causes also that room subject to such specialist cleaning need to be taken out of its' normal use for the period of cleaning. In rooms, where especial hygiene requirements are set, such as hospital patient rooms, additional costs for the building owner is generated as the room is thoroughly cleaned after specialist cleaning.

SUMMARY

An object of the present invention is to provide an apparatus for conditioning air in a room or space. The object is achieved by the features of the independent claim. In an embodiment, the apparatus comprises a frame; a cover panel into which a perforated or slotted area is arranged, the perforated area comprising perforations, each perforation having a diameter; and a heat exchanger arranged within the frame and comprising at least one heat exchanger coil, lamellas, and openings arranged between each adjacent lamella, each opening having a length. A ratio of the length of the openings and the diameter of the perforations is at least 2:1.

The aforementioned implementation embodiments offer a solution to the problems and disadvantages of the known prior art. Other technological benefits of the present invention become evident to a person skilled in the art from the following description and the claims. The numerous embodiments of implementing the present invention achieve only a part of the presented advantages. None of the advantages is critical to the embodiments of implementation. Any required embodiment can technically be combined with any other required embodiment. The embodiments represent only a few advantageous embodiments and they do not limit the idea of the invention that can also be implemented in other manners within the framework of the claims presented further below.

BRIEF DESCRIPTION OF THE DRAWINGS

The attached figures illustrate examples of embodiments of the present invention, and together with the above general description and the detailed current embodiments help to explain, by way of examples, the principles of the invention.

DETAILED DESCRIPTION

Figure 1:
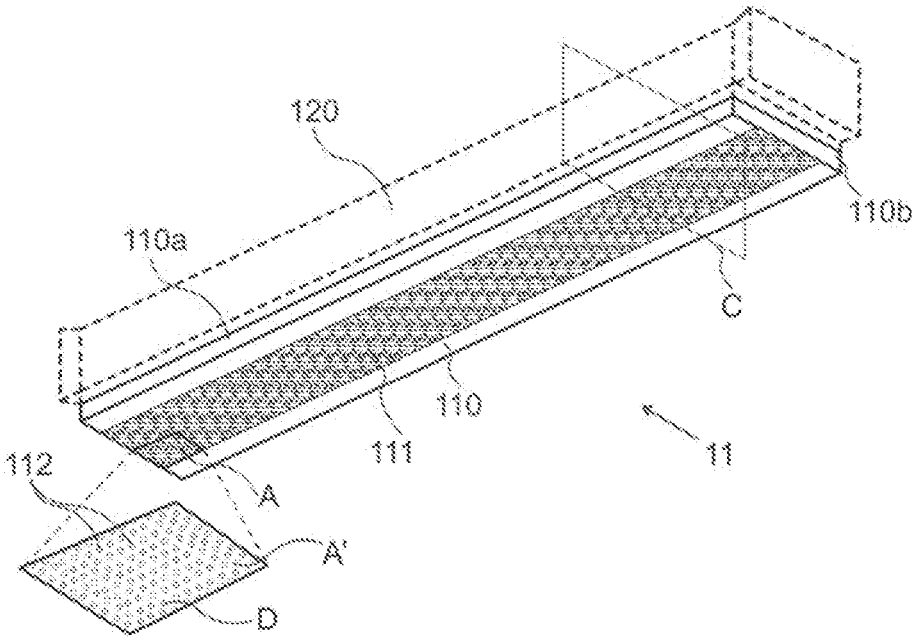
FIG. 1 illustrates a schematic illustration of an apparatus for air conditioning a room, and an enlargement of a cover panel of the apparatus, in accordance with an embodiment.
Figure 3:
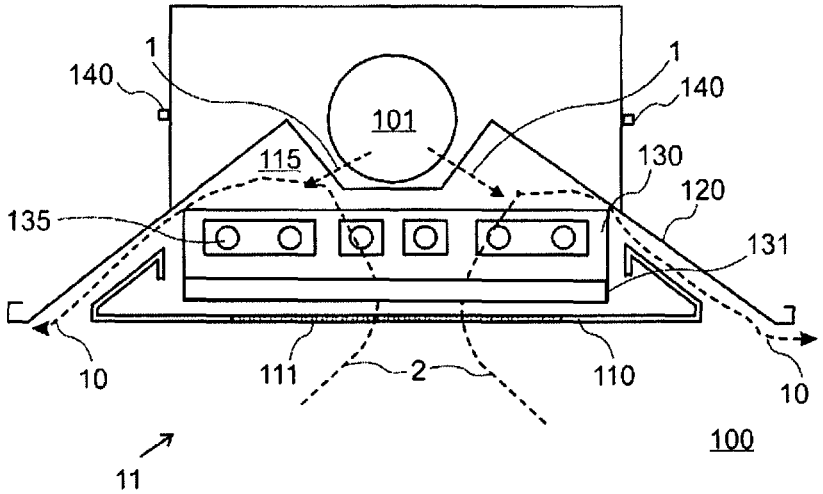
FIG. 3 illustrates schematic illustration of a cross-section of the apparatus configured to air conditioning a room, in accordance with an embodiment.

According to an embodiment, as depicted in FIG. 1, the apparatus 11, which can be used for conditioning the air in a room or space 100 such as a patient room, for example by heating or cooling the air, comprises a frame 120, a cover panel 110 and a heat exchanger 130. The frame 120 may be essentially a rectangular box or casing with two longer sides and two shorter end sides, which sides define an internal space 115 (as shown in FIG. 3) or opening into which the heat exchanger 130 can be arranged. The frame 120 may also have a square form having four sides of equal lengths, or it can be circular with one continuous side. The opening and the heat exchanger 130 arranged therein is covered by the cover panel 110. The frame 120 may have sides that are arranged at an angle deviant of vertical, to allow directing a flow of conditioned air 10 back into the space 100. There may be arranged gaps or open spaces between the cover panel 110 and the sides of the frame 120.

Figure 2:
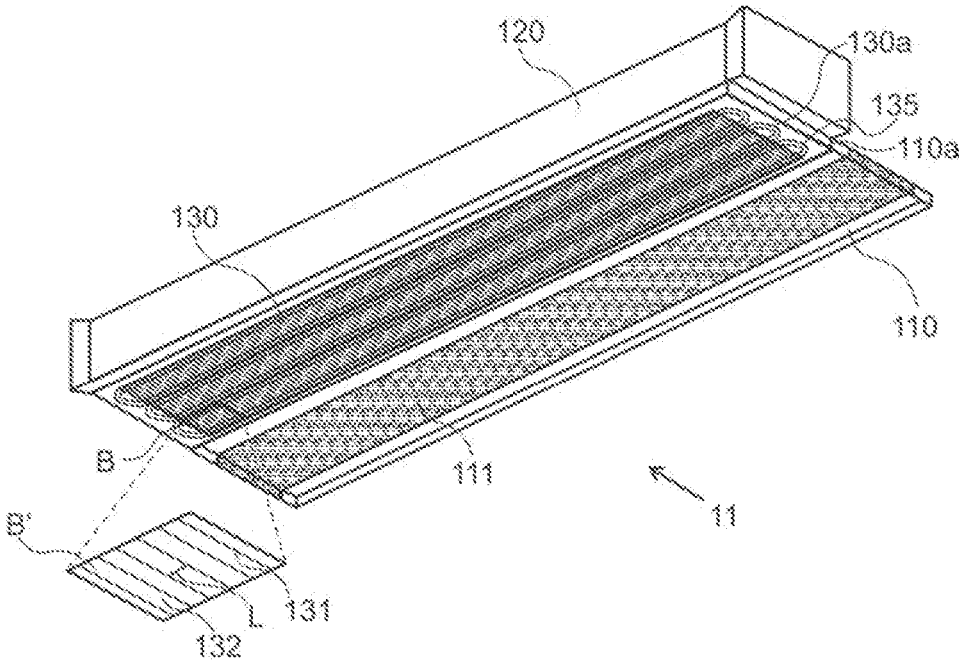
FIG. 2 illustrates a schematic illustration of an apparatus for air conditioning a room with the cover panel opened, and an enlargement of a heat exchanger of the apparatus, in accordance with an embodiment.

According to an embodiment, supply air flow 1 of air, which can be pre-cleaned or purified prior to its conduction to the apparatus 11, is led or conducted into the apparatus 11 via a supply duct 101, which opens into the internal space 115 of the apparatus 11, as shown in FIG. 3. In FIG. 1 and FIG. 2 the supply duct 101 is not shown for the sake of clarity, but it is to be understood that a supply air flow is led into the apparatus 11 via at least one supply air duct 101 connected into the apparatus 11 in a suitable manner and opening into the internal space 115 of the apparatus 11 to conduct and uniformly distribute the supply air flow 1 into the apparatus to be mixed with the air flow 2 entering into the apparatus 11 from the space 100 and being conditioned as it passed through the heat exchanger 130. In effect, the supply air flow draws the air flow 2 into the internal space 115 of the apparatus 11 by way of induction. The air flow 2 mixed with the supply air flow 1 flows back into the space 100 as conditioned clean air flow 10. According to an embodiment, the apparatus 11 may be an active AC apparatus intended to be both a supply air terminal apparatus and an air conditioning apparatus integrated into one combination.

The cover panel 110 comprises a perforated or slotted area 111 arranged into it. The perforated area 111 may cover the whole or part of the surface area of the cover panel 110. In the embodiment of FIG. 1, the perforated area 111 is arranged to extend longitudinally over the whole length of the cover panel 110, leaving two unperforated areas at the sides of the cover panel 110, again in longitudinal direction. The perforated area 111 comprises perforations 112 which may have a circular form, as illustrated in FIG. 1. The perforations 112 are arranged uniformly distributed onto the perforated area 110. According to other embodiments, the perforations 112 may have a form other than circular, such as squares or rectangles, may be used as well. The perforations 112 can be seen more clearly in the enlargement A' or the area A in FIG. 1.

Each perforation 112 has an open area with a diameter D which is the measurement between two opposing sides of the perforation. In an embodiment where the perforations 112 are circular, the diameter D is the diameter of each circular perforation. In an embodiment where the perforations 112 have a square form, the diameter D is the distance between two opposing sides of each square perforation. In an embodiment where the perforations 112 have a rectangular form, the diameter D is the shortest distance between two opposing sides of the rectangular perforation. The diameter D can vary between 1-3.5 mm. For example, the diameter can be 2.0 mm. In an embodiment, the diameter may be 1.1 mm; 1.8 mm; 2.2 mm; or 2.5 mm.

The cover panel 110 may reduce the amount of dust and other impurities entering the inside of the frame 120 and from there, from circulating back into the clean room 100. This may be due to the chosen diameter D of the perforations 112. Further, the cover panel 110 can be opened or removed from the frame 120 to enable cleaning and maintenance of the inside of the frame 120 and the heat exchanger 130. In an embodiment, the cover panel 110 is detachably attached into the frame 120 so that the cover panel 110 may be wholly removed. In another embodiment (FIG. 2), the cover panel 120 is pivotably connected to the frame 120 from its one edge (110*a*, 110*b*), so that the cover panel 110 may be opened without removing it wholly. The pivotal connection may comprise hinges or other such turning joints. In addition or alternatively, the cover panel 110 can be easily cleaned from outside the apparatus 11 with conventional cleaning equipment during the normal day-to-day cleaning operations of the room or space 100, i.e. no specialized cleaning operations or personnel are needed. Thus cover panel 110 can be made more hygienic.

By choosing a diameter D of the perforations 112 so that the front panel 120 is able to significantly reduce or hinder the migration of dust and other particles with air flow 2 into the inside of the frame 120, the apparatus 11 may be arranged to remove impurities from air flow 2 entering the apparatus 11. As further discussed later on in the description, lamellas of the heat exchanger 130 have greater distance so as to reduce the migration of dust and other particles with air flow 2 into the inside of the frame 120.

The heat exchanger 130, which can be seen for example in FIG. 2, comprises at least one heat exchanger coil 135 in which a heat exchange medium is arranged to circulate. In an embodiment the heat exchanger 130 utilizes dry heat transfer in order to eliminate or minimize the risk of condensation within the apparatus 11, and thereby avoiding creating favorable conditions for microbial growth, as well as avoiding the use of a filter for coil protection. Also other heat transfer types may be utilized.

The heat exchanger 130 further comprises a number of lamellas 131 and openings 132 arranged between each adjacent lamella 131. Each of the openings 132 have a length L, as measured from one lamella to the next as can be seen in the enlargement B' of the area B in FIG. 2. The length L can vary between 4-7 mm. For example, the length L can be 5 mm. In an embodiment, the length L may be 4.3 mm; 5.5 mm; 5.8 mm; 6.0 mm; or 6.5 mm. A greater length L of the openings 132 reduces the amount of dust and other impurities accumulating to the lamellas 131 and openings 132 thereof. The heat exchanger 130 may be more hygienic. Need to maintenance may be reduced.

According to an embodiment, the heat exchanger 130 may be detachably attached into the frame 120 to enable cleaning and maintenance of the inside of the frame 120 and the heat exchanger 130. In an embodiment, the heat exchanger 130 is detachably attached to the frame 120 so that the heat exchanger 130 may be wholly removed. In another embodiment, the heat exchanger 130 is pivotably connected to the frame 120 from one of the sides 130*a* of the heat exchanger 130, so that the heat exchanger may be removed partially from within the frame 120. The side 130*a* may here denote for example the heat exchanger coil 135, which can be hinged or otherwise pivotally connected to the frame 120. The pivotal connection may comprise hinges or other such turning or pivot joints. Also in the case of a pivotal connection, the heat exchanger 130 may be wholly removed from the frame 120 by removing the pivot part from its housing.

According to an embodiment, the length L of the openings 132 and the diameter D of the perforations 112 may be chosen to 1) ensure air conditioning for the clean room 100, and 2) reduce the circulation of dust and other impurities from the room or space 100 into the apparatus 11 and from there back into the clean room or space 100 with the flow 2 of conditioned air. According to an embodiment, a ratio of the length L of the openings 132 and the diameter D of the perforations 112 may be at least 2:1. The aforementioned ratio may vary for example between 2.5:1 to 3.0:1. In other embodiments, the ratio may be larger, for example 3.3:1 or 3.8:1. In an embodiment, the ratio is 2.5:1, in which case the length L of the openings 132 may be 5.0 mm and the diameter D of the perforations 112 may be 2.0 mm.

In an experiment, it was shown that an apparatus 11 according to an embodiment comprising a cover panel 110 with small diameter, for example 2 mm, perforations 112 may be significantly more efficient in preventing dust from entering the inside of the frame 120 than a conventional cover panel comprising larger diameter perforations. The cover panel 111 of the apparatus 11 and the heat exchanger 132 accumulated around 100% more dust on its room 100 facing surface 111 than a conventional panel and a conventional heat exchanger used as a reference in dusting experiments conducted over several days, where the dust accumulation was measured as a weight-% of controlled dust addition into the room 100. In the experiment, the total amount of dust introduced into the room 100 corresponded to the amount of dust accumulating into a room in normal use over a period of approximately two years. Further, it was found that less dust was collected in the openings 132 with a greater length L (6 mm) than in the openings 132 with a smaller length (3 mm). In the 6 mm lamella openings 132, dust was mainly collected in the ends of the lamellas (in longitudinal direction of the lamellas), whereas in the 3 mm lamella openings, dust was evenly collected into the entire length of the openings (in longitudinal direction of the lamellas), thus making the conventional heat exchanger lamellas more sensitive to clogging and more difficult to clean.

According to an embodiment, to further enhance the properties of the apparatus 11 in use in rooms and spaces, the apparatus 11 may have antibacterial properties. For example, the frame 120, the cover panel 110, the heat exchanger 130, or all of them, may have antibacterial properties. In an embodiment, the heat exchanger 130, the frame 120 and/or the cover panel 110 may be treated with an antibacterial surface treatment such as paint or other coating. Examples of this kind of surface treatment comprise silvering or silver plating, or treating the surface with a copper-based paint. The aforementioned parts may also be made from an antibacterial material. The heat exchanger coil 135 may be made from an antibacterial material such as copper. Also the heat exchanger coil 135 may be treated with a surface treatment such as the aforementioned silvering or silver plating or painting with a copper-based paint. According to an embodiment, the apparatus 11 may also provide an enhanced antibacterial performance of the heat exchanger 130 in use, because the accumulation of dust into the large surfaces of a conventional heat exchanger will impair the effect of the antibacterial surface.

In FIG. 3, which a cross-directional view C of an apparatus 11 of FIG. 1 according to an embodiment, is illustrated how the air flow 2 from the space 100 is received into the apparatus 11 by means of induction through the perforations 112 of the perforated area 111 of the cover panel 110. Further, a supply air flow 1 is led into internal space 115 of the apparatus 11 via a supply air duct 101. The supply air flow 1 may be pre-cleaned, pre-conditioned or otherwise treated prior to its conduction into the supply air duct 101 and the apparatus 11. The amount of dust and other impurities that enter into the internal space 115 of the apparatus 11 with the air flow 2 is reduced (or diminished) by the small diameter perforations 112. The air flow 2 enters the heat exchanger through the openings 132 (not shown in FIG. 3) between the lamellas 131, and is conditioned in the heat exchanger 130, is mixed with the supply air flow 1, and the mixed flow is then led back into the room 100 as a clean air flow 10 from which at least a part of the dust and other impurities have been removed. Appropriate length L of the openings 132 may prevent dust and impurities for sticking or accumulating to the heat exchanger 130.

Figure 4:
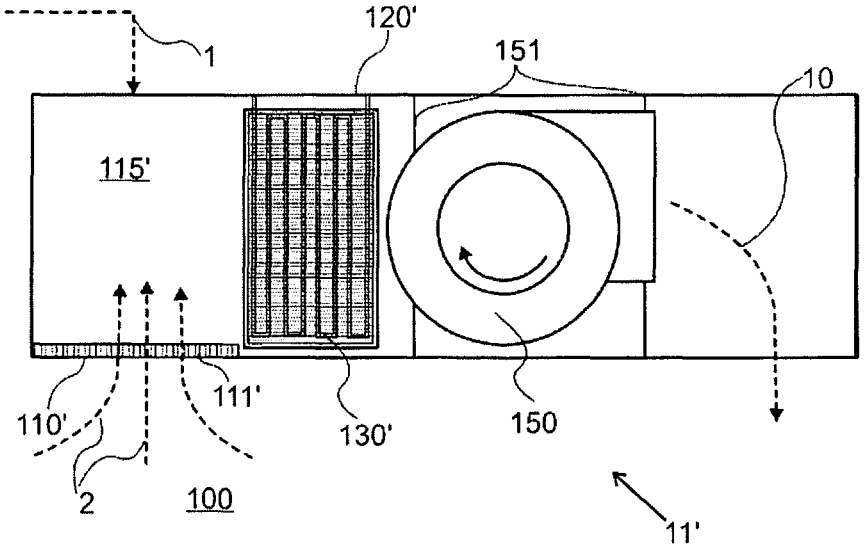
FIG. 4 illustrates a schematic illustration of an apparatus configured to air conditioning a room, in accordance with an embodiment.

In an embodiment, as illustrated in FIG. 4, the apparatus according to the invention is a fan-coil air conditioner 11'. The apparatus 11' comprises a frame 120' with an inner space 115' into which a heat exchanger 130' and a fan 150 are arranged. Air flow 2 is received into the apparatus 11' through a cover panel 110' comprising a perforated area 111'. In a typical fan-coil air conditioner, the air flow 2 is led into the internal space 115 via a filter preceded with a sparse louvre. In an embodiment according to the invention, the air flow 2 is led into the apparatus 11' via the perforated area 111' of the cover panel 110' alone, i.e. no filter and/or a louvre is employed, and the cover panel 110' may replace the louvre and the filter. A supply air flow 1 (which may be prefiltered or otherwise pretreated air) is led into the apparatus 11' from an outside source via a supply air duct (not shown).

The air flows are conditioned in the heat exchanger 130' and led back into the clean room 100 with the help of the fan 150. The fan may be isolated from the internal space 115' by screens or cut-off wall 150 which prevent internal back-circulation of conditioned air within the apparatus 11'. Dust and other impurities that may migrate into the apparatus 11' with the air flow 2 are effectively collected on the outside surface (as viewed from the room 100) of the cover panel 110', which is detachably attached into the frame 120' in the same manner as previously explained in connection with the first embodiment of the invention. In the apparatus 11', the air flow 2 is received from and led back to the room 100 by mechanical ventilation. However, there is no need to use any filters or filtering equipment in the apparatus 11' to ensure an acceptable level of cleanliness in the air flow 2, in contrast to conventional fan-coil apparatuses due to the diameter D of the perforations in the perforated area 111' of the cover panel 110', similarly as what has been explained above in connection with the other embodiments. Furthermore, the length L of the openings of the lamellas of the heat exchanger 130' may be according to the embodiments to prevent dust and impurities from sticking and accumulating to the lamellas and the openings.

The frame 120 may be installed into the ceiling 300 of the room 100, either directly into the ceiling structure so that the frame 120 is wholly or partially embedded into the ceiling structure so that only the cover plate 110 is visible, or a part of the frame 120 and the cover plate 110 is visible. Alternatively, the apparatus 11 may be installed to hang or otherwise extend from the ceiling 300 with any suitable mounts 140, as is shown in FIG. 3.

According to an embodiment, a layout and setting of apparatuses 11 within a space which is a room 100, is described. The object may be to produce more consistent level of cleanliness and thermal environment within the room 100 where human operations are practiced (FIG. 5), as well as provide apparatuses for conditioning air which can be easily cleaned. The room 100 may be a hospital room or a patient room, an office space or room, a hotel room, or any other space where air conditioning is needed.

In the room 100, at least some of the apparatuses used to treat the air are apparatuses 11, 11' according to the invention. The apparatuses 11, 11' are air conditioners. An apparatus 11 may be installed into the ceiling 300 of the clean room 100 either by embedding it wholly or partially into the ceiling or by mounting it on the ceiling to hang or otherwise extend downwards from the ceiling at a position most convenient to the critical operations of the clean room 100. Apparatuses may also be installed at the walls or into, or on the floor.

Figure 5:
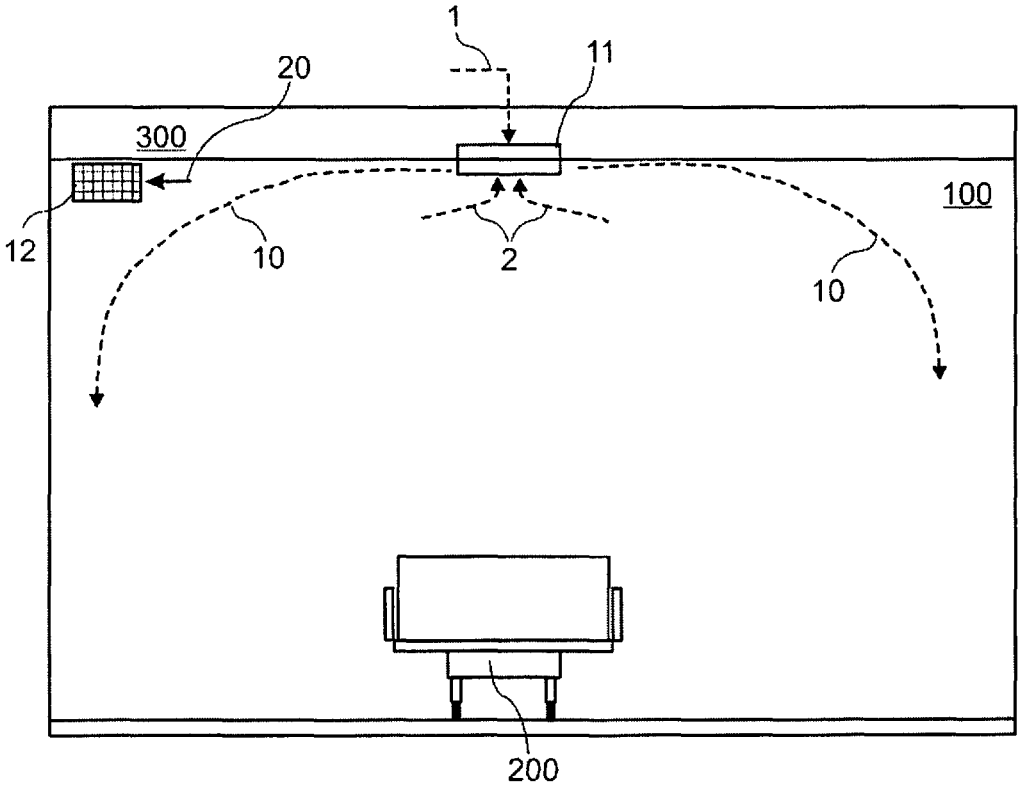
FIG. 5 illustrates a room comprising an apparatus configured to air conditioning the room in accordance with an embodiment.

In an embodiment, the room 100 is a patient room, and the critical healing or other operations take place at a patient bed 200, where it is crucial that the personnel and the patient to receive a flow of conditioned air to ensure comfort and an acceptable level of cleanliness, for example air flow with a suitable temperature and velocity with as little contaminants (either particles such as dust or fibres, or contaminants of microbial sources such as bacteria or spores). A supply air flow 1 of clean (pre-cleaned or prefiltered or otherwise pretreated) air may be led into the room 100. Air flow 2 is received into the apparatus 11 as described earlier by induction induced by the supply air flow 1 and/or mechanical ventilation, conditioned in the heat exchanger 130 arranged inside the frame 120 of the apparatus 11, mixed with the supply air flow 1 within the internal space 115 of the apparatus 11, and led back into the clean room 100 as return clean air flow 10. A part of the air is circulated in this manner; while a part 20 may be removed from the clean room 100 via air outlets 12, of which only one is shown in FIG. 5. The air outlets 12 may be arranged into the ceiling 300 or at the walls, for example near or adjacent to the ceiling 300. In an embodiment, alternatively or additionally, also gravitational ventilation may be used to achieve air flow 2 into the apparatus 11.

With the apparatus 11 as described earlier in connection with the embodiments, it may be ensured that a significant amount of dust and other impurities are prevented from entering the apparatus 11 and back into the room 100, while at the same time directing enough conditioned air flow into the needed area.

A need for costly specialist cleaning or maintenance operations can be reduced on account of prolonged time between those operations. The apparatus 11 may be conveniently cleaned during the normal cleaning and maintenance operations for the clean room 100, taking place for example once a day, or after each patient. The day-to-day cleaning may include wiping the cover plate 110 to remove the accumulated dust and other contaminants from the surface of the cover plate 110 facing the clean room 100. Periodically, the apparatus may be thoroughly cleaned by removing the cover plate 120 and the heat exchanger 130, but this specialized work or specialist cleaning operation is not necessary on a day-to-day basis. Therefore costly special work may be performed at longer intervals. The day-to-day cleaning may be performed without any special equipment or without climbing up from the floor level so normal cleaning personnel is able to execute it.

In an embodiment, the ratio of the length of the openings and the diameter of the perforations is between 2.5:1-3.5:1. In other embodiments, the ratio may be 2:1; 2.2:1; 3.3:1; 4.5:1 or 6.4:1.

In an embodiment, the diameter of the perforations is at least 1.8 mm, and the length of the openings is at least 5 mm.

In an embodiment, the diameter of the perforations is 1.8-2.5 mm. In other embodiments, the diameter of the perforations may be 1.1 mm; 2.0 mm; 2.2 mm; 3 mm or 3.5 mm.

In an embodiment, the length of the openings is 4-7 mm. In other embodiments, the length of the openings may be 4.2 mm; 4.5 mm; 5 mm; 5.8 mm; 6 mm; or 6.5 mm.

In an embodiment, the cover panel is at detachably attached into the frame.

In an embodiment, the cover panel is pivotally connected to the frame from an edge of the cover panel.

In an embodiment, the heat exchanger is detachably attached into the frame.

In an embodiment, the heat exchanger is pivotably connected to the frame from a side of the heat exchanger.

In an embodiment, at least one of the following has antibacterial properties: the frame, the cover panel, or the heat exchanger.

In another embodiment, the heat exchanger coil is made from copper or painted by an antibacterial paint.

In an embodiment, an air flow is received into the apparatus through the cover panel from a space outside the apparatus and the air flow is led back into the space by gravitational or forced ventilation or induction.

In an embodiment, the apparatus further comprises a fan, and an air flow is received into the apparatus from a space outside the apparatus and the air flow is led back into the space by mechanical ventilation.

In an embodiment in addition or alternatively, further including an internal space within the frame, into which internal space a supply air flow is conducted.

In another aspect of the invention, a room is described, the room comprising the apparatus of the any of the aforementioned embodiments, wherein the apparatus comprises an air conditioner.

For a person skilled in the art, it is obvious that numerous modifications and variations can be made to the equipment and the method. Other embodiments and exemplary implementations become evident to a person skilled in the art on the basis of the specification and practice related to the equipment and the method described. The purpose is that the specification and the embodiments be regarded only as exemplary, so that the following patent claims and their equivalents show the actual scope of protection.

The invention claimed is:

1. An apparatus for conditioning air in a room comprising:

a frame including an inlet through which a first air flow is introduced into an internal space of the frame, the internal space being arranged to receive the first air flow from a supply air inlet;

a cover panel into which a perforated area is arranged, the perforated area comprising perforations for a second air flow entering the apparatus, each perforation having a diameter from 1 mm to 3.5 mm and being exposed to the room; and a heat exchanger arranged within the frame and comprising at least one heat exchanger coil, lamellas, and openings arranged between each adjacent lamella, each opening having a width defined between the adjacent lamella, wherein the lamellas form part of the heat exchanger, wherein a ratio of the width of the openings and the diameter of the perforations is at least 2:1, wherein the second air flow is induced by the first air flow into the internal space via the perforations and the openings, and wherein the first and second air flows are mixed before being discharged into the room, wherein the perforations are configured to prevent dust collecting in the openings in the heat exchanger, and wherein the cover panel including the perforations is at a distance from the lamellas of the heat exchanger, wherein the second air flow travels sequentially through the cover panel, the lamellas, the at least one heat exchanger coil, and then out of an outlet of the frame.

2. The apparatus of claim 1, wherein the ratio of the width of the openings and the diameter of the perforations is between 2.5:1-3.5:1.

3. The apparatus of claim 1, wherein the diameter of the perforations is at least 1.8 mm, and the width of the openings is at least 5 mm.

4. The apparatus of claim 1, wherein the diameter of the perforations is 1.8-2.5 mm.

5. The apparatus of claim 1, wherein the width of the openings is 4-7 mm.

6. The apparatus of claim 1, wherein the cover panel is detachably attached to the frame.

7. The apparatus of claim 1, wherein the cover panel is pivotally connected to the frame at an edge of the cover panel.

8. The apparatus of claim 1, wherein the heat exchanger is detachably attached to the frame.

9. The apparatus of claim 1, wherein the heat exchanger is pivotably connected to the frame at a side of the heat exchanger.

10. The apparatus of claim 1, wherein at least one of the following have antibacterial properties: the frame, the cover panel, or the heat exchanger.

11. The apparatus of claim 10, wherein at least one of the heat exchanger coil comprises copper or the heat exchanger coil is painted with an antibacterial paint.

12. The apparatus of claim 1 further comprising a fan through which an air flow is received into the apparatus, and wherein an air flow is received into the apparatus from a space outside the apparatus and the air flow is led back into the space by mechanical ventilation.

13. A room comprising the apparatus of claim 1, wherein the apparatus comprises an air conditioner.

14. The apparatus of claim 1, wherein the perforated area extends over the cover panel, such that the perforated area is exposed to an environment outside of the apparatus.

15. The apparatus of claim 1, wherein the lamellas of the heat exchanger are fins extending in a direction parallel with a direction of the first air flow.

* * * * *